US008448388B1

(12) United States Patent
Karenbauer

(10) Patent No.: US 8,448,388 B1
(45) Date of Patent: May 28, 2013

(54) TAMPER-PROOF VASE

(71) Applicant: Michael Karenbauer, Bethel Park, PA (US)

(72) Inventor: Michael Karenbauer, Bethel Park, PA (US)

(73) Assignee: Matthew Resources, Inc., Wilmington, DE (US)

( * ) Notice: Subject to any disclaimer, the term of this patent is extended or adjusted under 35 U.S.C. 154(b) by 0 days.

(21) Appl. No.: 13/674,439

(22) Filed: Nov. 12, 2012

Related U.S. Application Data

(62) Division of application No. 12/878,315, filed on Sep. 9, 2010, now Pat. No. 8,307,584.

(60) Provisional application No. 61/240,801, filed on Sep. 9, 2009.

(51) Int. Cl.
*E01F 9/011* (2006.01)
*E04H 13/00* (2006.01)

(52) U.S. Cl.
USPC ..... 52/103; 52/104

(58) Field of Classification Search
USPC ..... 52/103, 104; 47/41.01
See application file for complete search history.

(56) References Cited

U.S. PATENT DOCUMENTS 1,924,149 A * 8/1933 Britton ..... 47/41.1
1,973,102 A * 9/1934 Reep ..... 47/41.01
1,995,771 A * 3/1935 Grueneberg ..... 47/41.1
2,488,924 A * 11/1949 Meierjohan et al. ..... 47/41.1
2,610,443 A * 9/1952 Carlson ..... 47/41.1
2,710,491 A * 6/1955 Carlson ..... 47/41.1
3,001,326 A * 9/1961 O'Brien et al. ..... 47/41.1
3,229,948 A * 1/1966 King ..... 248/346.03
3,312,014 A * 4/1967 Pfister, III ..... 47/41.1
3,377,043 A * 4/1968 King ..... 248/346.03
3,434,235 A * 3/1969 Gordon et al. ..... 47/41.1
4,306,376 A * 12/1981 Strassacker et al. ..... 47/41.1
4,522,366 A * 6/1985 Howell, III ..... 248/551
5,055,035 A * 10/1991 Hancovsky ..... 431/291
5,363,609 A * 11/1994 Hancovsky ..... 52/103
5,732,830 A * 3/1998 Harrington ..... 211/4
6,006,458 A * 12/1999 Weiss ..... 40/124.5
6,067,748 A * 5/2000 Williams ..... 47/41.01
6,088,955 A * 7/2000 Nelson et al. ..... 47/41.1
6,088,973 A * 7/2000 Weiss ..... 52/105
6,092,330 A * 7/2000 Pratt ..... 47/41.1
6,363,635 B1 * 4/2002 England ..... 40/124.5
6,907,692 B2 * 6/2005 Hintze ..... 47/41.12
6,922,927 B1 * 8/2005 Harmon ..... 40/124.5
2002/0007601 A1 * 1/2002 England ..... 52/103

* cited by examiner

*Primary Examiner* — Mark Wendell
(74) *Attorney, Agent, or Firm* — The Webb Law Firm, PC

(57) ABSTRACT

A vase assembly includes an outer vase including a top portion having an open top end, a bottom end, at least one sidewall, and an internal cavity, a base portion having a top end connected to the bottom end of the top portion, a bottom end, at least one sidewall, and an internal cavity, and at least one locking component disposed on the base portion. An insert is removably disposed within the internal cavity of the top portion of the outer vase. The insert includes an open top end, a closed bottom end, at least one sidewall, and an internal cavity. A locking mechanism removably secures the insert within the outer vase. The at least one locking component is adapted for securing the outer vase against removal from a support.

10 Claims, 10 Drawing Sheets

TAMPER-PROOF VASE

CROSS-REFERENCE TO RELATED APPLICATIONS

The present application is a divisional application of U.S. patent application Ser. No. 12/878,315, filed Sep. 9, 2010, which issued as U.S. Pat. No. 8,307,584 on Nov. 13, 2012, and which claims the benefit of U.S. Provisional Patent Application No. 61/240,801, filed Sep. 9, 2009, both of which are incorporated herein by reference in their entirety.

BACKGROUND OF THE INVENTION

1. Field of the Invention

The present invention is related to vase assemblies for use with a grave memorial or other support and, more specifically, to methods and apparatus for preventing tampering with or vandalizing such vase assemblies.

2. Description of Related Art

Grave stone marker stones and memorials, especially of the flat, cast bronze type, are frequently provided with bronze or copper vases for containing flowers or other items over the top surface of the memorial. Such vases are typically stored below the flat memorial in an upside down configuration via a hole formed in the flat memorial.

Due to the high value for bronze and copper materials, such vases are increasingly subject to being stolen and sold as scrap. Additionally, such vases are subject to vandalism and damage due to being completely removable from the grave memorial.

Current solutions to these trends include providing plastic vases with the memorial. However, plastic vases are easily damaged or broken and do not fully match the appearance of the bronze marker. Additionally, markers are being provided with only an opening for a vase but not an accompanying vase. The customer then must separately purchase a vase for use with the memorial. Such a solution does not ensure proper compatibility between the memorial and the vase, decreases overall sales in the grave memorial industry, and does not address the problem of theft should the customer decide to purchase a metal vase.

SUMMARY OF THE INVENTION

Accordingly, there is a general need for a tamper and theft-proof metal vase assembly to be provided with a grave memorial, especially of the flat, cast bronze type, that can be stored within or below the grave memorial and cannot be fully removed from the grave memorial so as prevent theft of, or damage to, the metal vase.

In one non-limiting aspect, the present invention provides a metal vase assembly used in cemeteries to display flowers or other items on bronze grave memorials that cannot be removed from the memorial and is thus theft resistant.

In another non-limiting aspect, the present invention provides an insert that is removably disposed within a metal outer vase so that the outer vase can be secured against removal from a grave memorial and still retain full functionality.

In yet another non-limiting aspect, the present invention provides a grave memorial that is capable of storing a metal vase assembly in an upright position and supporting the metal vase in an extended position above a top surface of the memorial without the necessity of removing the metal vase from the grave memorial.

According to an embodiment of the present invention, a vase assembly is provided. The vase assembly includes an outer vase including a top portion having an open top end, a bottom end, at least one sidewall and an internal cavity defined by the bottom end and the at least one sidewall. A base portion has a top end connected to the bottom end of the top portion, a bottom end, at least one sidewall and an internal cavity defined by the top end, the bottom end and the at least one sidewall of the base portion, and at least one locking component disposed on the base portion; an insert removably disposed within the internal cavity of the top portion of the outer vase, the insert including an open top end, a closed bottom end, at least one sidewall and an internal cavity defined by the open top end, the closed bottom end and the at least one side wall of the insert; and a locking mechanism for removably securing the insert within the outer vase. The at least one locking component is adapted for securing the outer vase against removal from a support. The insert is made of plastic material and the outer vase is made of metal material. The outer vase further includes a locking hole extending from the bottom end of the top portion to the top end of the base portion, such that the internal cavity of the top portion is in communication with the internal cavity of the base portion. The locking mechanism includes a T-shaped locking tab disposed on the closed bottom end of the insert, the T-shaped locking tab extending through the locking hole into the internal cavity of the base portion of the outer vase when the insert is fully disposed within the internal cavity of the top portion of the outer vase. The locking hole has a rectangular shape and the insert is rotatable within the top portion of the outer vase between an unlocked position where an end piece of the T-shaped locking tab aligns with the locking hole such that the insert is removable from the outer vase and a locked position where the end piece of the T-shaped locking tab traverses the locking hole so as to engage an interior surface the top end of the base portion such that the insert is secured within the outer vase. A stop is disposed on the interior surface of the top end of the base portion of the outer vase. The stop is adapted for engaging the end piece of the T-shaped locking tab so as to limit relative rotation between the insert and the outer vase. A lid is hingedly attached to the insert proximate to the open top end of the insert and pivotable between a closed position covering the open top end of the insert and an open position exposing the open top end of the insert. The lid has a locking member disposed on a bottom surface thereof. The insert further includes a protrusion disposed on an interior surface thereof, proximate to the open top end of the insert, the locking member of the lid engages the protrusion when the lid is in the closed position so as to secure the lid in the closed position. A handle is pivotably attached to the outer vase proximate to the open top end of the top portion of the outer vase. The at least one locking component includes a plurality of feet disposed on the base portion of the outer vase about a perimeter of the bottom end of the base portion. The feet are adapted for engaging the support. The insert has a shape substantially conforming to a shape of the internal cavity of the top portion of the outer vase.

According to a further embodiment of the present invention, a grave memorial is provided. The grave memorial includes a top surface having an opening defined therein, a locking assembly disposed within the opening, a storage canister disposed below the opening, and a vase assembly, the vase assembly including an outer vase including a top portion having an open top end, a bottom end, at least one sidewall and an internal cavity defined by the open top end, the bottom end and the at least one sidewall of the top portion, a base portion having a top end connected to the bottom end of the top portion, a bottom end, at least one sidewall and an internal cavity defined by the top end, the bottom end and the at least one sidewall of the base portion, and at least one locking component disposed on the base portion, an insert removably disposed within the internal cavity of the top portion of the outer vase, the insert including an open top end, a closed bottom end, at least one sidewall and an internal cavity defined by the open top end, the closed bottom end and the at least one sidewall of the insert, and a locking mechanism for removably securing the insert within the outer vase. The vase assembly is movable with respect to the grave memorial from an extended position where the outer vase extends through the opening in the top surface of the grave memorial to a stored position where the vase assembly is disposed substantially within the canister. The at least one locking component on the outer vase engages the locking assembly of the grave memorial such that the locking assembly supports the vase assembly in the extended position and prevents the outer vase from being removed from the grave memorial. The locking assembly of the grave memorial includes a continuous top flange disposed about a perimeter of the opening and a plurality of bottom flanges disposed about the perimeter of the opening below the continuous top flange, the continuous top flange and the bottom flanges defining a groove therebetween. The at least one locking component includes a plurality of feet disposed on the base portion of the outer vase about a perimeter of the bottom end of the base portion. The bottom flanges are spaced so as to allow the feet to pass therebetween, the top flange is adapted to engage the feet such that the feet are not movable through the opening past the top flange and the bottom flanges are adapted to engage the feet when the feet are disposed within the grooves so as to support the vase assembly in the extended position. The insert of the vase assembly is made of plastic material and the outer vase is made of metal material. The outer vase further includes a locking hole extending from the bottom end of the top portion to the top end of the base portion such that the internal cavity of the top portion is in communication with the internal cavity of the base portion. The locking mechanism includes a T-shaped locking tab disposed on the bottom end of the insert, the T-shaped locking tab extending through the locking hole into the internal cavity of the base portion of the outer vase when the insert is fully disposed within the internal cavity of the top portion of the outer vase. The locking hole has a rectangular shape and the insert is rotatable within the top portion of the outer vase between an unlocked position where an end piece of the T-shaped locking tab aligns with the locking hole such that the insert is removable from the outer vase and a locked position wherein the end piece of the T-shaped locking tab traverses the locking hole so as to engage an interior surface of the top end of the base portion such that the insert is secured within the outer vase. The vase assembly further includes a stop disposed on the interior surface of the top end of the base portion of the outer vase, the stop being adapted for engaging the end piece of the T-shaped locking tab so as to limit relative rotation between the insert and the outer vase. A lid is hingedly attached to the insert proximate to the open top end of the insert and pivotable between a closed position covering the open top end of the insert and an open position exposing the open top end of the insert, the lid having a locking member disposed on a bottom surface thereof, the lid being adapted to also cover the opening in the top surface of the grave memorial in the closed position when the vase assembly is in the stored position. The insert further includes a protrusion disposed on an interior surface thereof, proximate to the open top end of the insert, the locking member of the lid engaging the protrusion when the lid is in the closed position so as to secure the lid in the closed position. The vase assembly further includes a handle pivotably attached to the outer vase proximate to the open top end of the top portion of the outer vase. The insert has a shape substantially conforming to a shape of the internal cavity of the top portion of the outer vase.

Further details and advantages of the present invention will become clear upon reading the following detailed description in conjunction with the accompanying drawing figures, wherein like parts are designated with like reference numerals throughout.

DESCRIPTION OF THE INVENTION

For purposes of description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Figure 1:
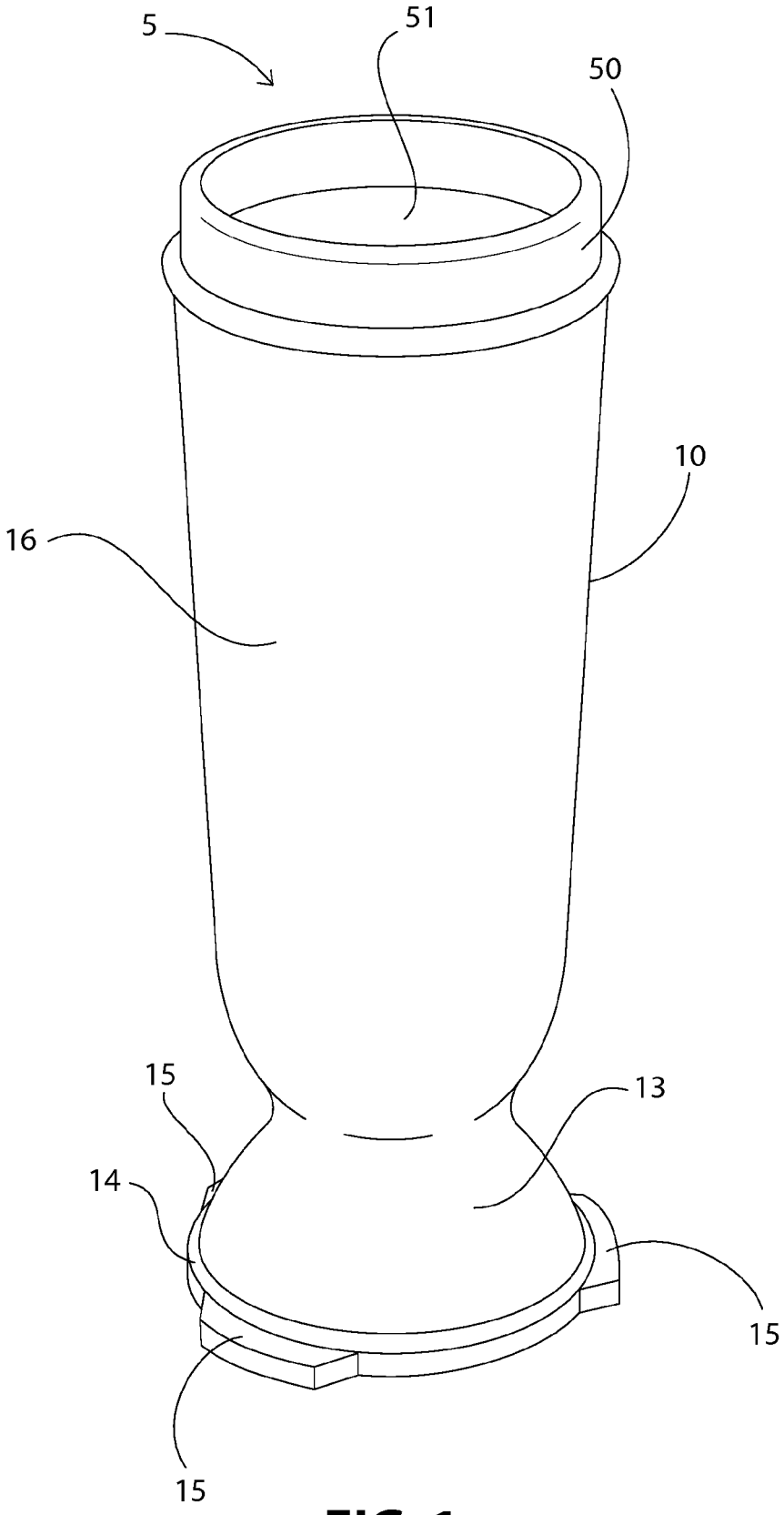
FIG. 1 depicts a top side perspective view of a tamper-proof vase assembly according to an embodiment of the present invention.

FIGS. 1-7 depict a tamper-proof vase assembly 5 for displaying flowers and other items on a grave marker memorial according to an embodiment of the present invention. As shown in FIG. 1, the vase assembly 5 includes an outer vase 10 having a top portion 16 and a base portion 13 connected to the top portion 16. The outer vase 10 is preferably made of metal material, particularly bronze or copper, according to various techniques known to those of ordinary skill in the art including casting processes. It is to be appreciated that any suitable metal or non-metal material may be used to make the outer vase 10. The top portion 16 and the base portion 13 are integrally formed, as shown, with the top portion 16 having a substantially cylindrical shape and the base portion 13 having a substantially semispherical shape to form a Doric-style outer vase 10. It is to be appreciated that the outer vase 10 may be formed of any suitable style or shape and that the top portion 16 and the base portion 13 may be made as separate components, which are subsequently connected together.

With reference to FIG. 1, the base portion 13 includes a peripheral flange 14 disposed about the circumference of the base portion 13. A plurality of circumferentially spaced feet 15 are disposed on the base portion 13 about a perimeter of the bottom end 22 (shown in FIG. 4) of the base portion 13 and extend outward from the peripheral flange 14. Feet 15 act as locking components for securing the outer vase 10 against removal from a support or the grave memorial, as will be discussed below, and also support the outer vase 10 in an upright position. As shown, three circumferentially spaced feet 15 are provided about the peripheral flange 14 of the base portion 13. It is to be appreciated that any suitable number of feet 15 may be provided for securing the outer vase 10 against removal from the grave memorial.

Figure 2:
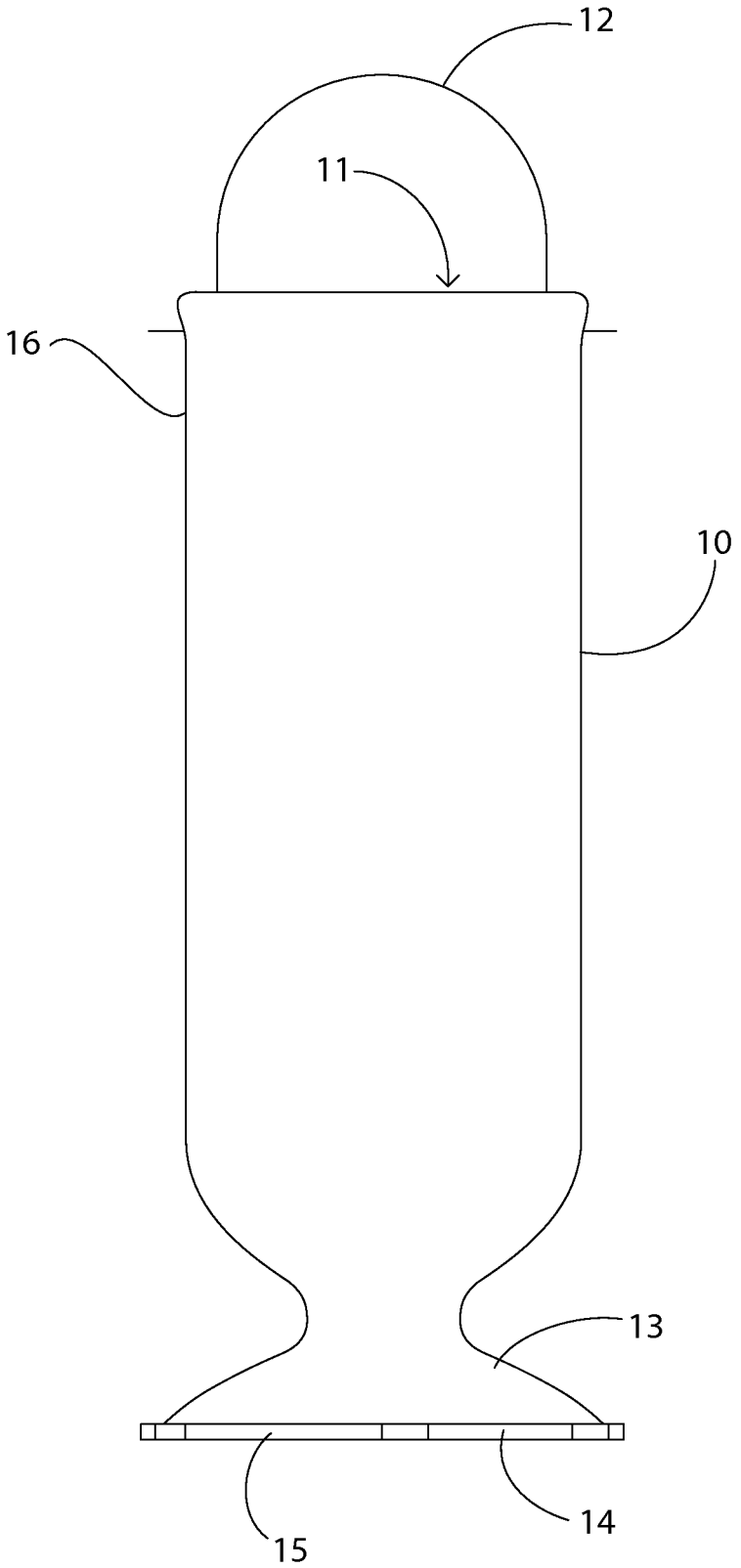
FIG. 2 depicts a side view of an outer vase with a handle according to an embodiment of the present invention.

As shown in FIG. 2, the top portion 16 of the outer vase 10 has an open top end 11. A handle 12 is pivotably attached to the outer vase 10 proximate to the open top end 11 so as to facilitate lifting and lowering of the outer vase 10. As shown, the handle 12 is similar to handles commonly provided on buckets and is attached through a sidewall 23 (shown in FIG. 4) of the top portion 16 of the outer vase 10 and extends upward from an internal cavity 24 (shown in FIG. 4) of the top portion 16 through the open top end 11 of the outer vase 10. The handle 12 is formed so as to be storable within the internal cavity 24 of the top portion 16 of the outer vase 10 when not in use.

Figure 3:
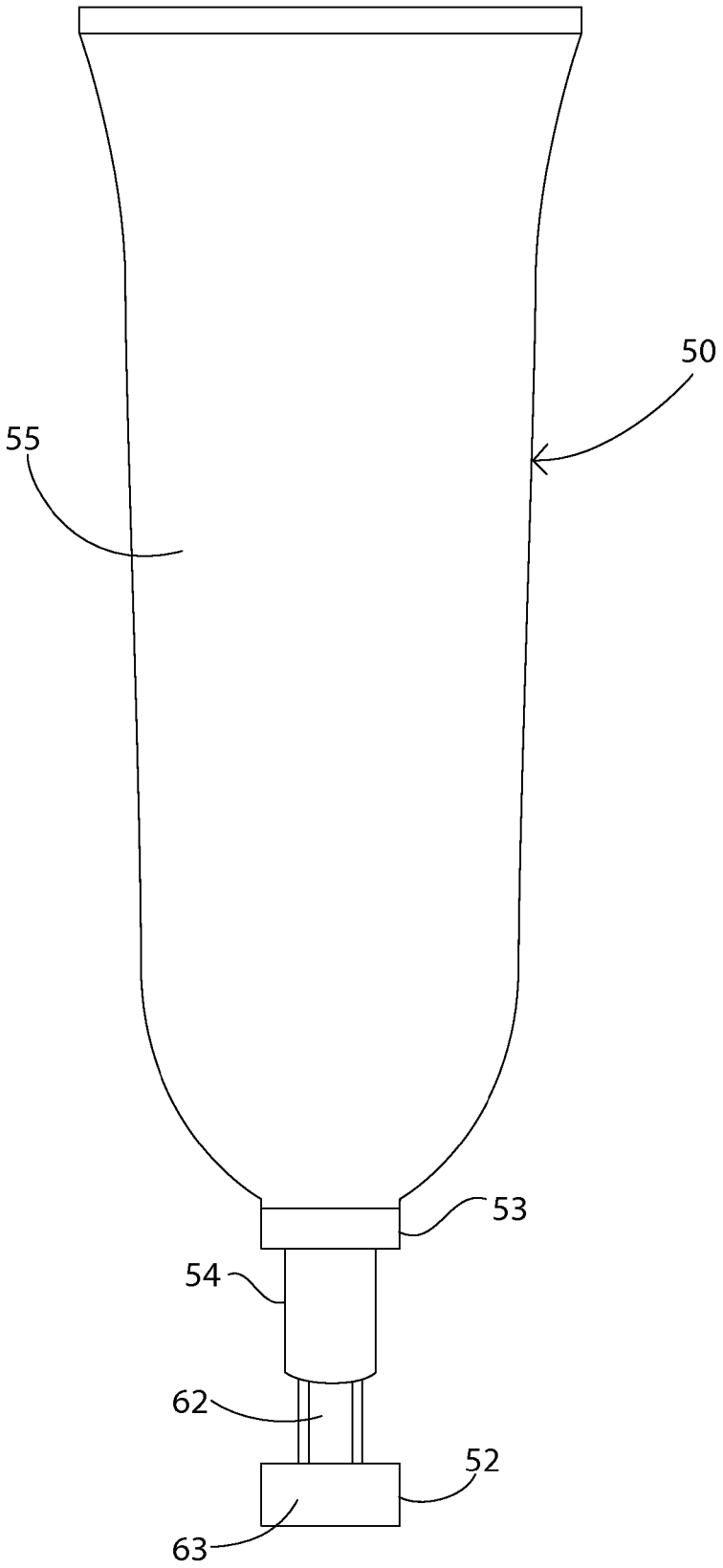
FIG. 3 depicts a side view of a vase insert of the tamper-proof vase assembly according to an embodiment of the present invention.

With reference to FIGS. 1 and 3, the tamper-proof vase assembly 5 includes an insert 50 removably disposed within the top portion 16 of the outer vase 10. The insert 50 has a top portion 55 with an open top end 51. The top portion 55 of the insert is preferably made of plastic material. It is to be appreciated that any suitable material may be used to make the top portion 55 of the insert 50. The insert 50 also includes a bottom shoulder 53 and a connecting portion 54, which is attached to the bottom shoulder 53 below the top portion 55 of the insert 50. A T-shaped locking tab 52 is attached to the insert 50 by the connecting portion 54. The T-shaped locking tab 52 acts as a locking mechanism for removably securing the insert 50 within the outer vase 10. The T-shaped locking tab 52 includes a base piece 62 attached to and depending from the connecting portion 54 and an end piece 63 extending transversely, with respect to the base piece 62. Alternatively, the T-shaped locking tab 52 may be directly connected to a closed bottom end 59 of the insert 50, as shown in FIGS. 3 and 4.

Figure 4:
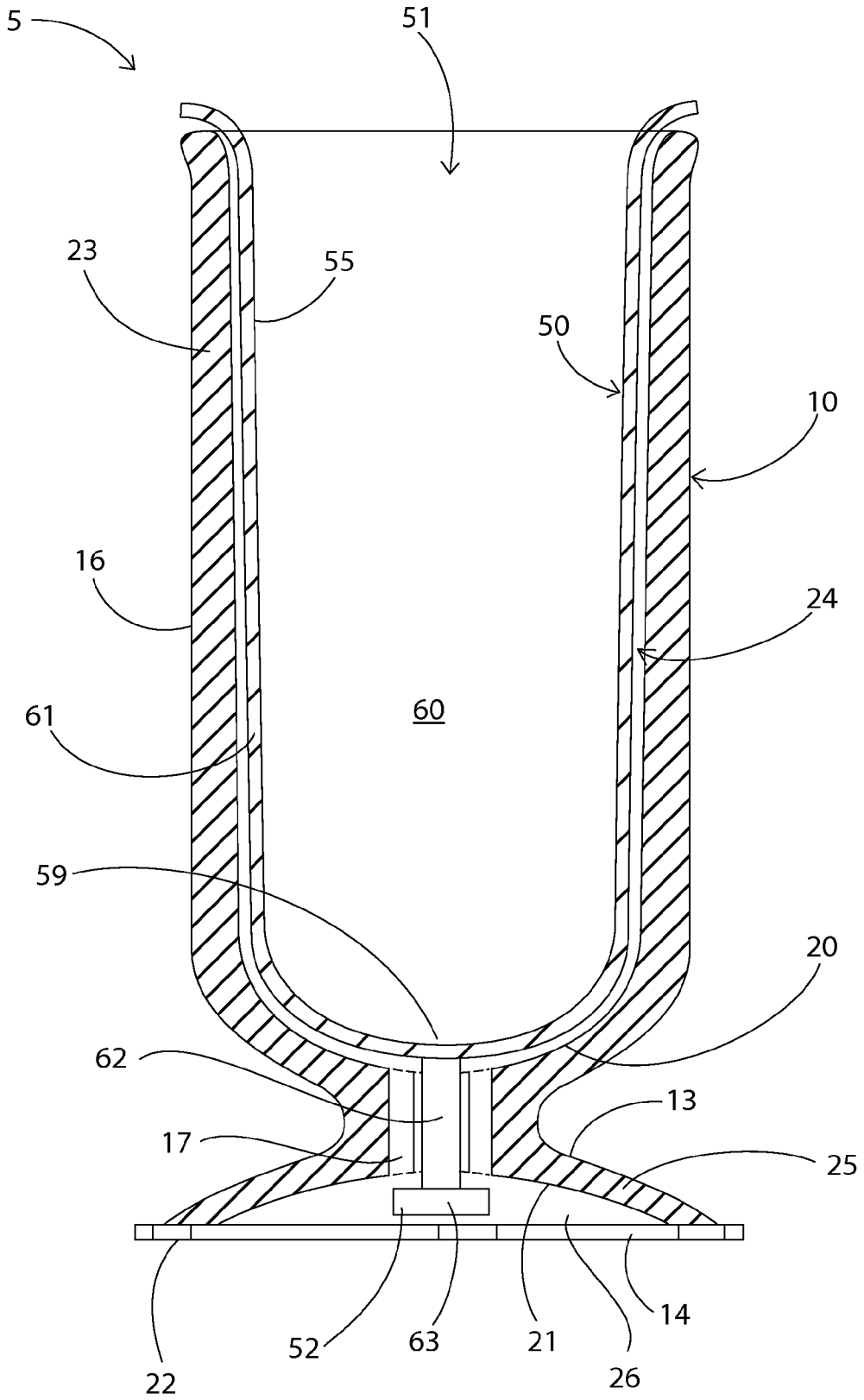
FIG. 4 depicts a partial cross-sectional view of the tamper-proof vase assembly with the insert in an unlocked position.
Figure 5:
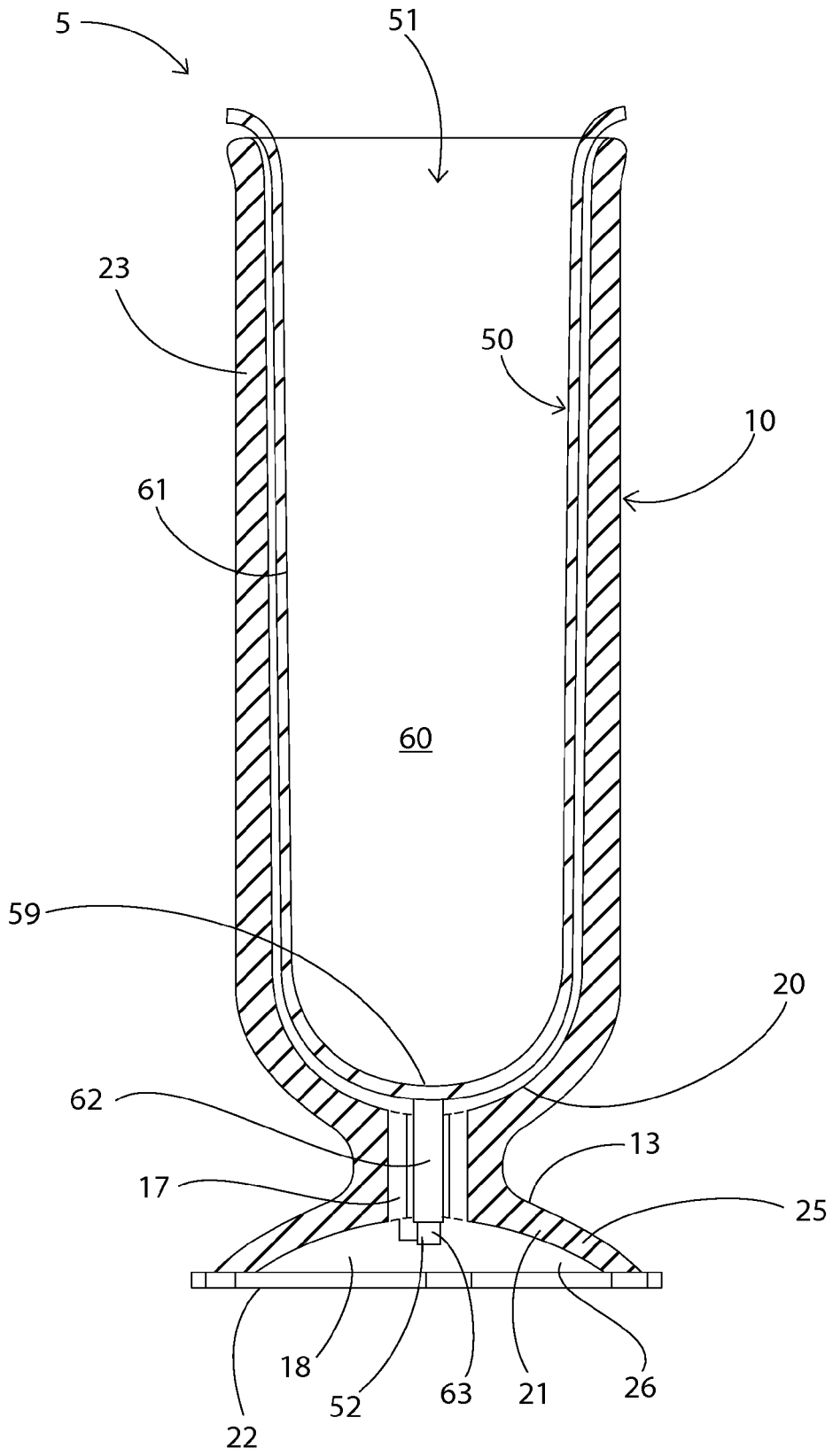
FIG. 5 depicts a partial cross-sectional view of the tamper-proof vase assembly with the insert in a locked position.
Figure 6:
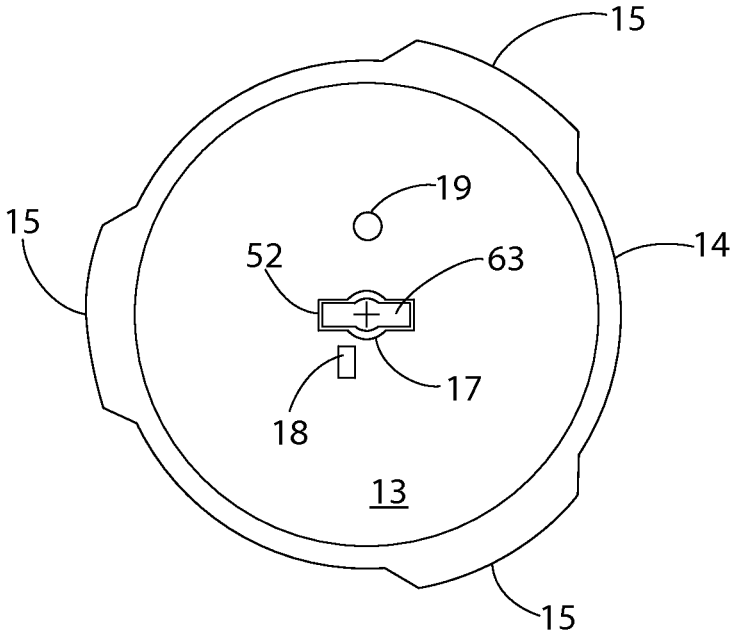
FIG. 6 depicts a bottom view of the tamper-proof vase assembly with the insert in an unlocked position.
Figure 7:
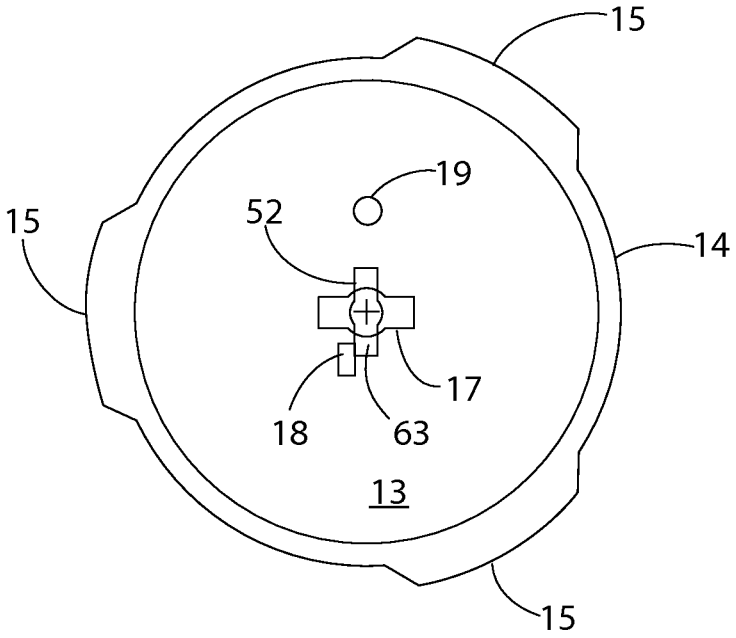
FIG. 7 depicts a bottom view of the tamper-proof vase assembly with the insert in a locked position.

As shown in FIGS. 4 and 5, the top portion 16 of the outer vase 10 has at least one sidewall 23 and a bottom end 20, which together with the open top end 11 define an internal cavity 24 of the top portion 16 of the outer vase 10. The insert 50 is removably disposed within the internal cavity 24 of the top portion 16 of the outer vase 10 and is secured within the outer vase 10 by the T-shaped locking tab 52. The base portion 13 of the outer vase 10 has a top end 21, a bottom end 22 and at least one sidewall 25. The bottom end 22 of the base portion 13 is open as shown in FIGS. 6 and 7, though the bottom end 22 could be closed without departing from the scope of the present invention. The top end 21, the bottom end 22, and the at least one sidewall 25 define an internal cavity 26 of the base portion 13 of the outer vase 10. The top end 21 of the base portion 13 is connected to the bottom end 20 of the top portion 16. The outer vase 10 includes an interior locking hole 17 extending through the outer vase 10 from the bottom end 20 of the top portion 16 to the top end 21 of the base portion 13, such that the internal cavity 24 of the top portion 16 is in communication with the internal cavity 26 of the base portion 13 of the outer vase 10.

The top portion 55 of the insert 50 has a substantially cylindrical shape so as to substantially conform to the shape of the internal cavity 24 of the top portion 16 of the outer vase 10. The top portion 55 of the insert 50 has an open top end 51, a closed bottom end 59, and at least one sidewall 61, which define an internal cavity 60 of the insert 50. As is shown in FIGS. 4 and 5, when the insert 50 is fully disposed within the top portion 16 of the outer vase 10, the T-shaped locking tab 52 extends through the locking hole 17 in the outer vase 10 and into the internal cavity 26 of the base portion 13.

With reference to FIGS. 4 and 6, the vase assembly 5 is depicted with the insert 50 in an unlocked position with respect to the outer vase 10. In the unlocked position, the end piece 63 of the T-shaped locking tab 52 aligns with the locking hole 17, which has a rectangular shape, such that the insert 50 is removable from the outer vase 10.

With reference to FIGS. 5 and 7, the vase assembly 5 is depicted with the insert 50 having been rotated, with respect to the outer vase 10, into a locked position, with respect to the outer vase 10. In the locked position, the end piece 63 traverses the locking hole 17 so as to engage an interior surface of the top end 21 of the base portion 13, such that the insert 50 is secured within the outer vase 10. A stop 18 is disposed on the interior surface of the top end 21 of the base portion 13. When the insert 50 is rotated, with respect to the outer vase 10, into the locked position, the stop 18 will engage the end piece 63 of the T-shaped locking tab 52 so as to limit relative rotation between the insert 50 and the outer vase 10.

With reference to FIGS. 6 and 7, the outer vase 10 also includes a drainage hole 19 extending through the outer vase 10 from the bottom end 20 of the top portion 16 to the top end 21 of the base portion 13 in order prevent the top portion 16 of the outer vase 10 from filling with debris or water.

Figure 8A:
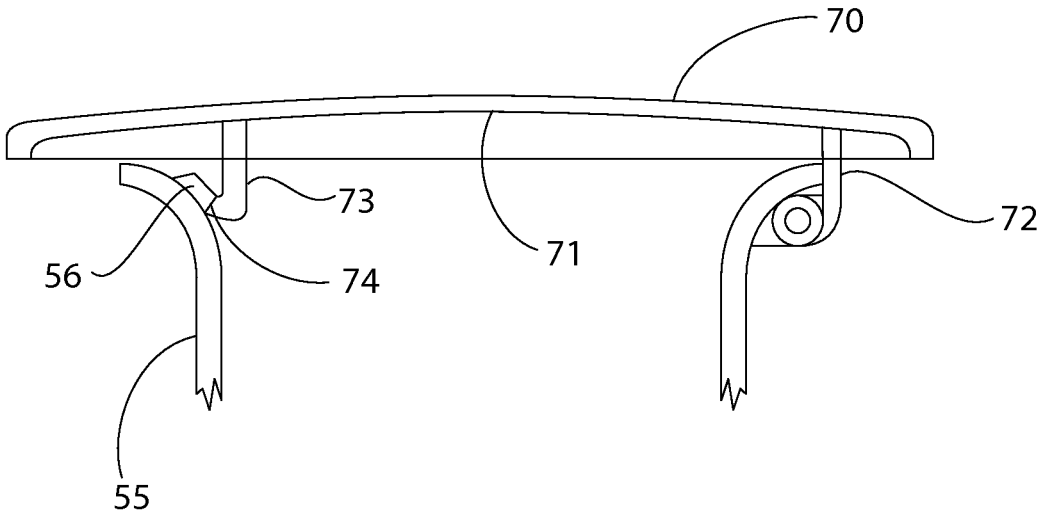
FIG. 8A depicts a cross-sectional view of a top portion of an insert having a lid hingedly attached thereto, according to an embodiment of the present invention.
Figure 8B:
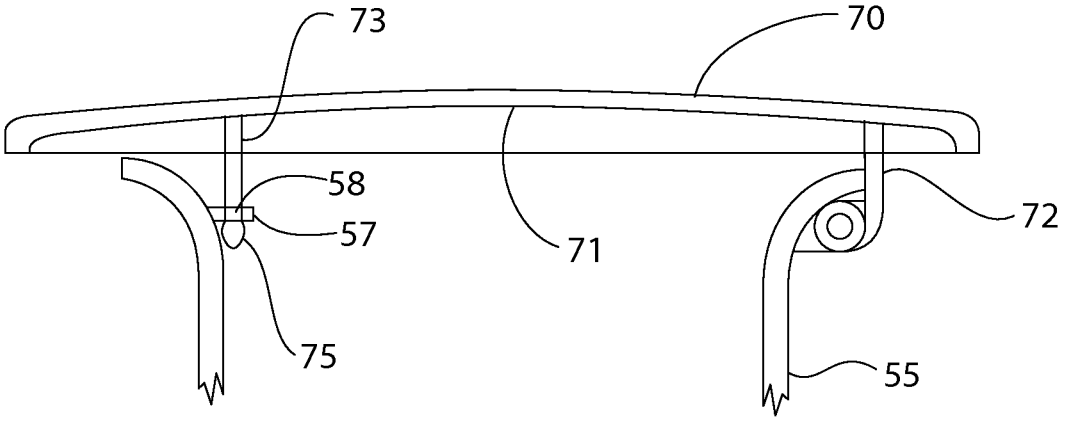
FIG. 8B depicts a cross-sectional view of a top portion of an insert having a lid hingedly attached thereto, according to an embodiment of the present invention.

With reference to FIGS. 8A and 8B, a lid 70 is attached to the top portion 55 of the insert 50 proximate to the open top end 51 of the insert 50 by a hinge member 72 connected between a bottom surface 71 of the lid 70 and an exterior surface of the top portion 55 of the insert 50. It is to be appreciated that the hinge member 72 may be of any type known to those of ordinary skill in the art to be suitable for creating a pivotable attachment between the lid 70 and the insert 50 and may be connected to the lid 70 and the insert 50 by any suitable fastener mechanism or molding technique. The lid 70 is pivotable between a closed position covering the open top end 51 of the insert 50 and an open position exposing the open top end 51 of the insert 50. The lid 70 further includes a locking member 73 extending from the bottom surface 71 of the lid 70.

As shown in FIG. 8A, the locking member 73 includes a hook 74 at an end distal from the bottom surface 71 of the lid 70. When the lid 70 is in the closed position, the hook 74 engages a protrusion 56 disposed on the interior surface of the top portion 55 of the insert 50 proximate to the open top end 51 of the insert 50 so as to secure the lid 70 in the closed position.

As shown in FIG. 8B, the locking member 73 includes a knob 75 at an end distal from the bottom surface 71 of the lid 70. When the lid 70 is in the closed position, the knob 75 passes through a hole 58 in a thin, flat protrusion 57 disposed on the interior surface of the top portion 55 of the insert 50 proximate to the open top end 51 of the insert 50. The knob 75 engages the hole 58 in an interference fit so as to secure the lid 70 in the closed position.

Figure 9:
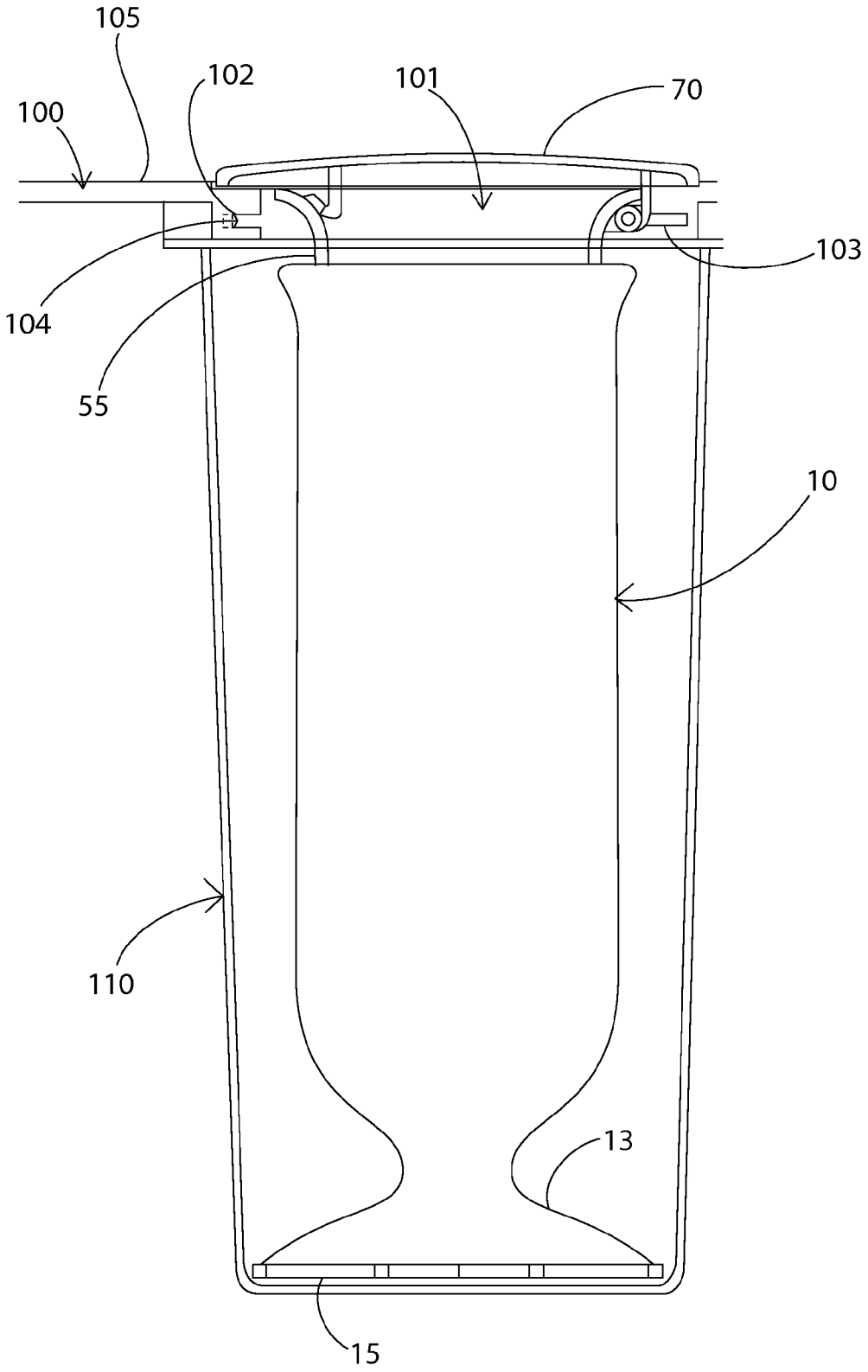
FIG. 9 depicts a partial cross-sectional view of a grave memorial and vase assembly, with the vase assembly in a stored position according to an embodiment of the present invention.

With reference to FIG. 9, a grave memorial 100 that includes the vase assembly 5 is shown. The grave memorial 100 is of a flat bronze marker type, though it is to be appreciated that the vase assembly 5 may be used with any type of grave memorial including an upstanding stone or concrete marker or may be incorporated into a pedestal or other type of support. The grave memorial 100 includes a top surface 105 and an opening 101 defined in the top surface 105 of the memorial 100. For a flat bronze marker, as shown, the opening 101 can be formed during the casting process through the use of a sand core. A storage canister 110 is disposed below the opening 101 either within or below the grave memorial or support 100. As shown in FIG. 9, the storage canister 110 holds the vase assembly 5 in a stored position when the vase assembly 5 is not in use.

Figure 10:
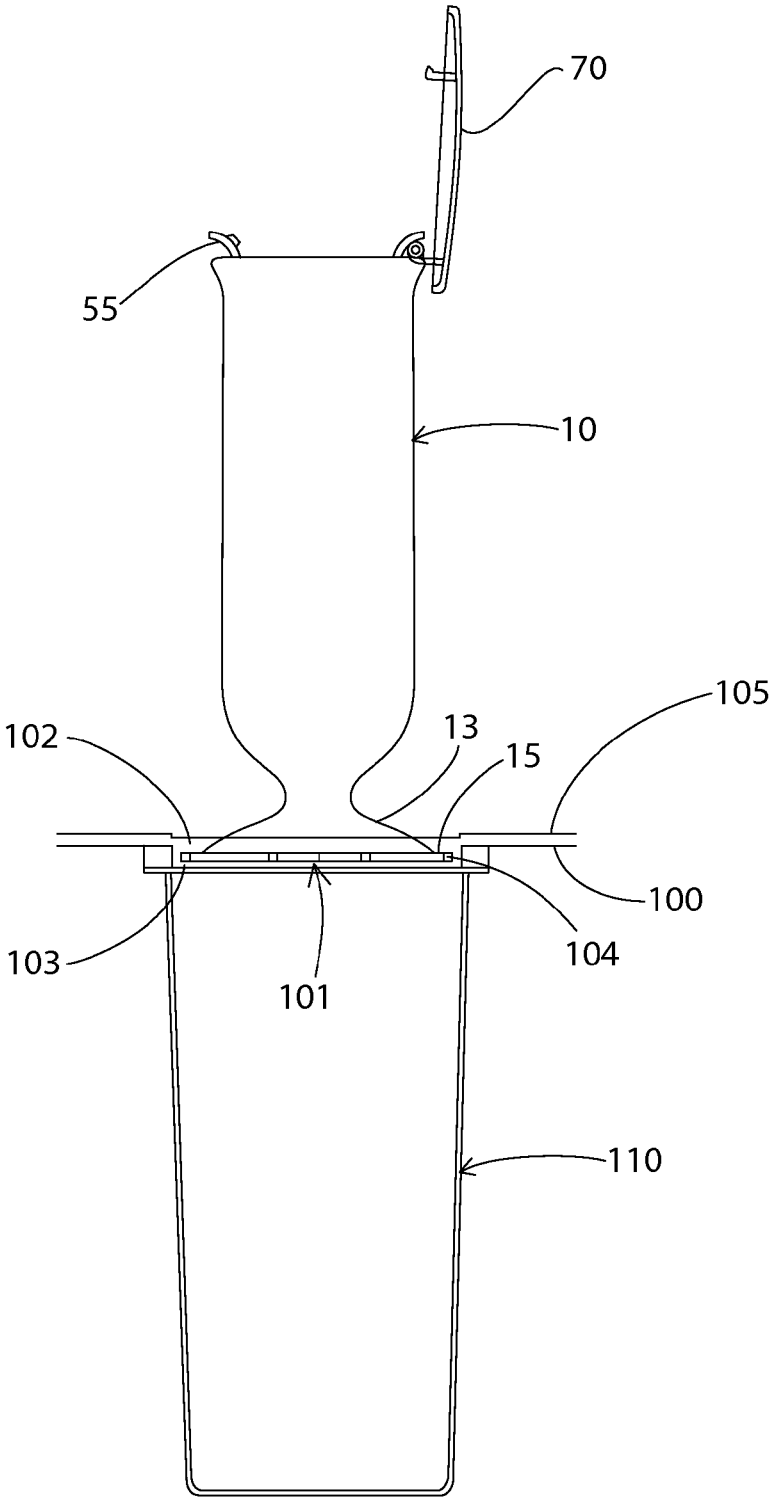
FIG. 10 depicts a partial cross-sectional view of the grave memorial and the vase assembly, with the vase assembly in an extended position according to an embodiment of the present invention.

With reference to FIGS. 9 and 10, the vase assembly 5 is movable with respect to the grave memorial 100 between an extended position; shown in FIG. 10, where outer vase 10 extends through the opening 101 in the top surface 105 of the grave memorial 100 and a stored position; shown in FIG. 9, where the vase assembly 5 is disposed substantially within the storage canister 110. As shown in FIG. 9, in the stored position, the insert 50 extends upward through the opening 101 such that the lid 70 rests upon the top surface 105 of the grave memorial 100 so as to also cover the opening 101 when the lid 70 is in the closed position.

Figure 11:
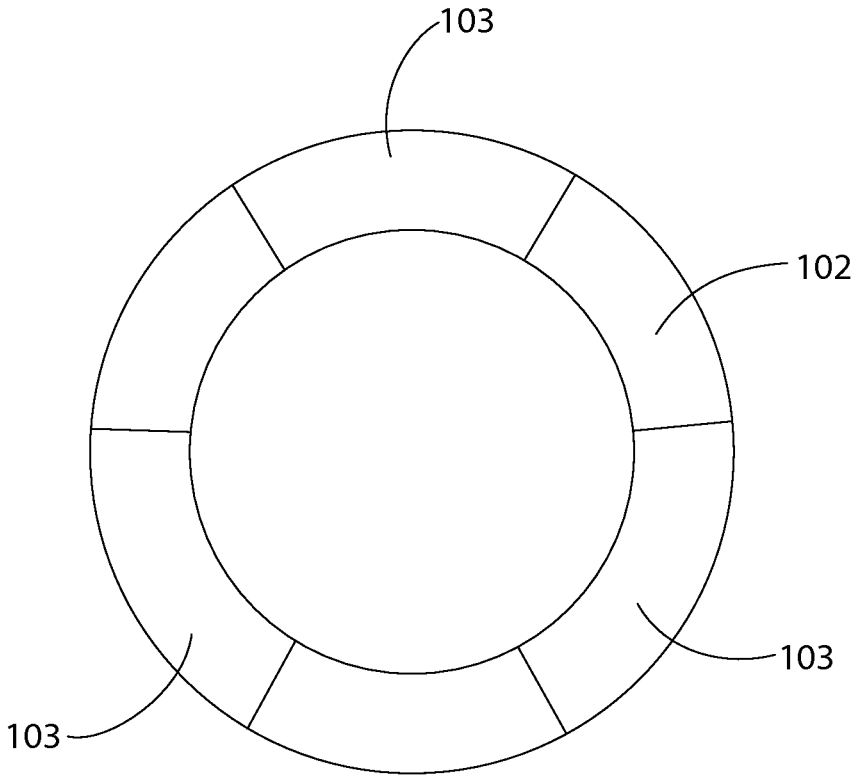
FIG. 11 depicts a bottom plan view of an opening, and top and bottom locking flanges of the grave memorial.

With reference to FIGS. 9-11, the grave memorial 100 includes a locking assembly disposed within the opening 101. The locking assembly includes a continuous top flange 102 disposed about a perimeter of the opening 101 and a plurality of bottom flanges 103 disposed about the perimeter of the opening 101 below the continuous top flange 102. A groove 104 is defined between the continuous top flange 102 and each of the bottom flanges 103. The continuous top flange 102, bottom flanges 103, and grooves 104 are formed during the casting process through the use of the sand core. As shown in FIG. 10, the continuous top flange 102 has a diameter less than the diameter of the peripheral flange 14 of the base portion 13 of the outer vase 10, such that the outer vase 10 cannot be removed completely from the grave memorial 100 due to the continuous top flange 102 engaging the feet 15, which act as locking components on the base portion 13 of the outer vase 10, such that the feet 15 are not movable through the opening 101 past the top flange 102.

As shown in FIGS. 10 and 11, the bottom flanges 103 are spaced about the perimeter of the opening 101 so as to allow the feet 15 to pass between the bottom flanges 103 as the vase assembly 5 is moved from the stored position to the extended position and vice versa. As shown, the opening 101 includes three bottom flanges 103, though it is to be appreciated that any suitable number of bottom flanges 103 may be formed in the opening 101 corresponding to the number of feet 15 on the base portion 13 of the outer vase 10. When the outer vase 10 is moved to the extended position, shown in FIG. 10, the outer vase 10 is rotated with respect to the opening 101, such that the feet 15 pass into the grooves 104 between the continuous top flange 102 and bottom flanges 103 so as to engage the bottom flanges 103, which support the vase assembly 5 in the extended position.

With reference to FIGS. 1-11, according to an embodiment of the present invention, the vase assembly 5 may be used in combination with a suitably formed or retrofitted grave memorial 100 or support as follows. When not in use, the vase assembly 5 is retained within the storage canister 110 below or within the grave memorial 100. The lid 70 rests on the top surface 105 of the grave memorial 100 so as to cover the open top end 51 of the insert 50 and the opening 101 in the grave memorial 100. In order to place the vase assembly 5 in the extended position on the grave memorial 100, a user rotates the insert 50 with respect to the outer vase 10 and the opening 101 by the lid 70 such that the end piece 63 of the T-shaped locking tab 52 aligns with the locking hole 17 in the outer vase 10. The user then removes the insert 50 from the outer vase 10 and the storage canister 110 and lifts the outer vase 10 from the stored position to the extended position by the handle 12, which has been stored within the internal cavity 24 of the top portion 16 of the outer vase 10. The outer vase 10 is then rotated with respect to the opening, such that the feet 15 pass into the grooves 104 between the continuous top flange 102 and the bottom flanges 103 in the opening 101. The feet 15 are thus engaged by the bottom flanges 103 so as to support the outer vase 10 in the extended position.

The continuous top flange 102 engages the peripheral flange 14 and the feet 15 on the base portion 13 of the outer vase 10, such that the outer vase cannot be completely removed from the grave memorial 100 or support. This prevents the outer vase 10, which is preferably formed from bronze or copper, from being tampered with or stolen.

Once the outer vase 10 is placed in the extended position, the insert 50 can be placed back into the outer vase 10 and rotated, with respect to the outer vase 10, into the locked position with the end piece 63 of the T-shaped locking member 52 traversing the locking hole 17 in the outer vase 10 so as to engage the interior surface of the top end 21 of the base portion 13. The lid 70 can then be raised from the closed position to the open position to allow water and flowers or other items to be placed in the top portion 55 of the insert 50 via the open top end 51.

When it is time to return the vase assembly 5 to the stored position, the insert 50 is removed from the outer vase 10 for disposal of its contents. The outer vase 10 is then rotated, with respect to the opening 101, so as to disengage the bottom flanges 103 and lowered into the storage canister 110 by the handle 12. The lid 70 is placed in the closed position covering the open top end 51 of the insert 50 and the insert 50 is replaced in the outer vase 10 and rotated into the locked position, such that the lid 70 seals the insert 50 and outer vase 10 and covers the opening 101 in the top surface 105 of the grave memorial 100.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of any invention which is to be given the full breadth of the appended claims and any and all equivalents thereof.

What is claimed is:

1. A grave memorial, comprising:

a top surface having an opening defined therein;

a locking assembly disposed within the opening;

a storage canister disposed below the opening; and a vase assembly, the vase assembly comprising:

an outer vase including a top portion having an open top end, a bottom end, at least one sidewall and an internal cavity defined by the open top end, the bottom end and the at least one sidewall of the top portion, a base portion having a top end connected to the bottom end of the top portion, a bottom end, at least one sidewall and an internal cavity defined by the top end, the bottom end and the at least one sidewall of the base portion, and at least one locking component disposed on the base portion;

an insert removably disposed within the internal cavity of the top portion of the outer vase, the insert including an open top end, a closed bottom end, at least one sidewall and an internal cavity defined by the open top end, the closed bottom end and the at least one side wall of the insert; and a locking mechanism for removably securing the insert within the outer vase, wherein vase assembly is movable with respect to the grave memorial from an extended position, wherein the outer vase extends through the opening in the top surface of the grave memorial to a stored position, wherein the vase assembly is disposed substantially within the canister, and wherein the at least one locking component on the outer vase engages the locking assembly of the grave memorial, such that the locking assembly supports the vase assembly in the extended position and prevents the outer vase from being removed from the grave memorial.

2. The grave memorial according to claim 1, wherein the locking assembly of the grave memorial comprises a continuous top flange disposed about a perimeter of the opening and a plurality of bottom flanges disposed about the perimeter of the opening below the continuous top flange, the continuous top flange and the bottom flanges defining a groove therebetween, the at least one locking component comprises a plurality of feet disposed on the base portion of the outer vase about a perimeter of the bottom end of the base portion, and the bottom flanges are spaced so as to allow the feet to pass therebetween, the top flange being adapted to engage the feet, such that the feet are not movable through the opening past the top flange, and the bottom flanges being adapted to engage the feet when the feet are disposed within the grooves so as to support the vase assembly in the extended position.

3. The grave memorial according to claim 1, wherein the insert of the vase assembly is comprised of plastic material and the outer vase is comprised of metal material.

4. The grave memorial according to claim 1, wherein the outer vase further includes a locking hole extending from the bottom end of the top portion to the top end of the base portion, such that the internal cavity of the top portion is in communication with the internal cavity of the base portion.

5. The grave memorial according to claim 4, wherein the locking mechanism comprises a T-shaped locking tab disposed on the closed bottom end of the insert, the T-shaped locking tab extending through the locking hole into the internal cavity of the base portion of the outer vase when the insert is fully disposed within the internal cavity of the top portion of the outer vase.

6. The grave memorial according to claim 5, wherein the locking hole has a rectangular shape and the insert is rotatable within the top portion of the outer vase between an unlocked position, wherein an endpiece of the T-shaped locking tab aligns with the locking hole such that the insert is removable from the outer vase and a locked position, wherein the endpiece of the T-shaped locking tab traverses the locking hole, so as to engage an interior surface of the top end of the base portion such that the insert is secured within the outer vase.

7. The grave memorial according to claim 6, wherein the vase assembly further comprises a stop disposed on the interior surface of the top end of the base portion of the outer vase, the stop being adapted for engaging the endpiece of the T-shaped locking tab so as to limit relative rotation between the insert and the outer vase.

8. The grave memorial according to claim 1, wherein the vase assembly further comprises:

a lid hingedly attached to the insert proximate to the open top end of the insert and pivotable between a closed position covering the open top end of the insert and an open position exposing the open top end of the insert, the lid having a locking member disposed on a bottom surface thereof, the lid being adapted to also cover the opening in the top surface of the grave memorial in the closed position when the vase assembly is in the stored position, wherein the insert further includes a protrusion disposed on an interior surface thereof, proximate to the open top end of the insert, the locking member of the lid engaging the protrusion when the lid is in the closed position so as to secure the lid in the closed position.

9. The grave memorial according to claim 1, the vase assembly further comprising a handle pivotably attached to the outer vase proximate to the open top end of the top portion of the outer vase.

10. The grave memorial according to claim 1, wherein the insert has a shape substantially conforming to a shape of the internal cavity of the top portion of the outer vase.

* * * * *

UNITED STATES PATENT AND TRADEMARK OFFICE

CERTIFICATE OF CORRECTION

PATENT NO. : 8,448,388 B1
APPLICATION NO. : 13/674439
DATED : May 28, 2013
INVENTOR(S) : Karenbauer It is certified that error appears in the above-identified patent and that said Letters Patent is hereby corrected as shown below:

On the Title Page, Item (73) Assignee, Line 1, delete "Matthew"
and insert -- Matthews --

Signed and Sealed this
Tenth Day of September, 2013

Teresa Stanek Rea
*Acting Director of the United States Patent and Trademark Office*